US005363964A

United States Patent [19]

Hexter, Jr.

[11] Patent Number: 5,363,964

[45] Date of Patent: Nov. 15, 1994

[54] EMBOSSED METAL TRADING CARD AND CONTAINER THEREFORE

[75] Inventor: Peter K. Hexter, Jr., Wilmington, N.C.

[73] Assignee: CUI, Inc., Wilmington, N.C.

[21] Appl. No.: 121,267

[22] Filed: Sep. 14, 1993

[51] Int. Cl.[5] ..... B65D 85/48; G09F 1/12

[52] U.S. Cl. ..... 206/449; 40/154; 40/156; 40/642; 206/454

[58] Field of Search ..... 206/449, 454, 485, 425; 40/154, 156, 642; 270/528, 529, 533, 527

[56] References Cited

U.S. PATENT DOCUMENTS

| | | | |
|---|---|---|---|
| 782,199 | 2/1905 | Keplinger | 40/156 |
| 1,117,085 | 11/1914 | Potts . | |
| 1,924,429 | 8/1933 | Winzeler . | |
| 2,113,871 | 4/1938 | Bozung | 40/154 |
| 3,322,299 | 5/1967 | Foster . | |
| 3,508,484 | 4/1970 | Hickey . | |
| 4,125,655 | 11/1978 | Kanzelberger . | |
| 4,291,798 | 9/1981 | Transport . | |
| 4,309,835 | 1/1982 | Naeve . | |
| 4,446,966 | 5/1984 | Moloney | 206/454 X |
| 4,515,838 | 5/1985 | Miyajima . | |
| 4,624,875 | 11/1986 | Watanabe et al. . | |
| 4,695,103 | 9/1987 | MacDonald et al. | 206/425 X |
| 4,767,647 | 8/1988 | Bree . | |
| 4,779,752 | 10/1988 | Vallee et al. | 220/533 |
| 4,889,232 | 12/1989 | Asleson | 206/449 |
| 4,995,508 | 2/1991 | Burley . | |
| 5,010,673 | 4/1991 | Connor et al. . | |
| 5,133,450 | 7/1992 | Rademacher . | |
| 5,147,041 | 9/1992 | Lemieux et al. . | |
| 5,148,942 | 9/1992 | Snook . | |
| 5,158,175 | 10/1992 | Crawford . | |
| 5,199,568 | 4/1993 | Streit et al. . | |
| 5,201,414 | 4/1993 | Kaszubinski . | |
| 5,215,792 | 6/1993 | Miller . | |

*Primary Examiner*—Bryon P. Gehman
*Attorney, Agent, or Firm*—Carter & Schnedler

[57] ABSTRACT

A collectible trading card made of embossed metal, and a boxed set of such cards. The card advantageously combines two mediums, metal for appearance and durability, and cardboard which affords high quality printing. In particular, the card includes a generally rectangular metal substrate having front and rear sides, and a cardboard insert sheet adjacent the rear side. The metal substrate includes a central main portion, four edge marginal portions terminating in respective substrate edges, and four corner marginal portions. The marginal portions surround the central main portion, sharing respective boundaries therewith, and are rolled towards the substrate rear side and around such that the substrate edges contact the insert sheet so as to hold the insert sheet in position. The rolled marginal portions together define a continuous bead around the periphery of the card without any exposed sharp edges. A boxed set includes a plurality of such trading cards, received in a storage tin within which there are a lower card support member having a plurality of channels for receiving the lower edges of the trading cards, and a pair of side card support members, each also having corresponding pluralities of channels for receiving side edges of the trading cards.

11 Claims, 4 Drawing Sheets

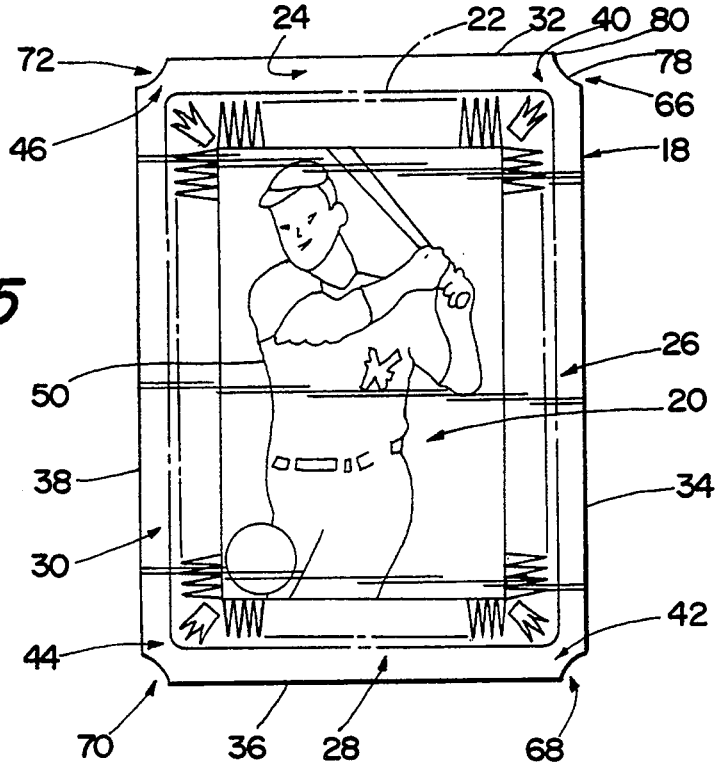
Fig. 5
Fig. 6
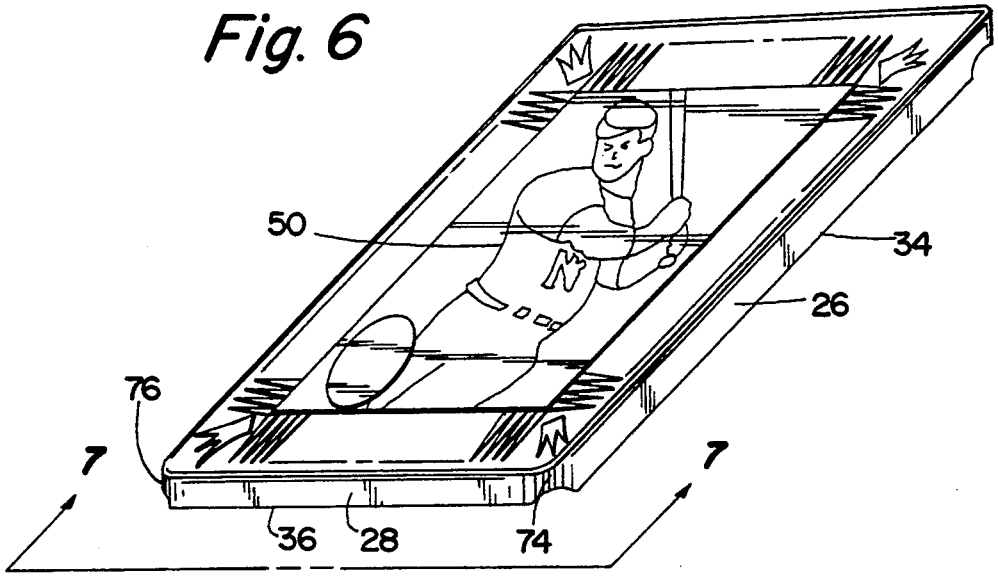
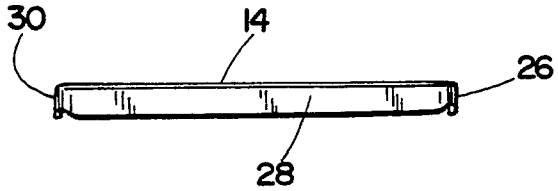
Fig. 7

EMBOSSED METAL TRADING CARD AND CONTAINER THEREFORE

BACKGROUND OF THE INVENTION

The invention relates generally to collectible trading cards, such as baseball trading cards and, more particularly, to trading cards made of metal. As employed herein, the term "trading card" is intended to refer broadly to any such card-like object having information printed on either or both sides, whether it is in fact used for collection and trading purposes, merely collected, or otherwise.

Traditionally, such collectible trading cards have been made of thin cardboard, with a photograph on one side, and information printed on the other side.

Recently, for permanency and enhancement of appearance, it has been proposed to make such cards of lithographed sheet metal, for example as is disclosed in Miller U.S. Pat. No. 5,215,792. However, one disadvantage of such metal trading cards is that it is difficult, if not impossible, to achieve on sheet metal the quality of printing which can be achieved on other sheet materials, particularly paper-based sheet materials.

Another disadvantage, recognized in the above-referenced Miller patent, is that a raw piece of sheet metal contains sharp edges and corners which would make such a piece unsafe for use as a trading card. In view of this, Miller proposes a construction wherein the edges are folded to form flat hems presenting radiused surfaces at least on the outer edges of the card, leaving unfolded edges only at the corners, which unfolded edges are short in length.

SUMMARY OF THE INVENTION

Accordingly, it is an object of the invention to provide a metallic trading card or the like of enhanced appearance.

It is another object of the invention to provide a metallic trading card or the like which is free of raw edges and sharp corners and which is thus safe to handle.

It is another object of the invention to advantageously employ the malleable characteristic of metal to provide metallic trading cards with decorative features not readily achievable in conventional thin cardboard trading cards.

It is yet another object of the invention to provide a metallic trading card which is readily manufacturable.

It is still another object of the invention to provide a boxed set of metallic trading cards including design elements common to all the cards of the set.

Briefly, in accordance with the invention there is provided a metallic trading card or the like which advantageously combines two mediums, metal and a paper-based sheet material. More particularly, the metallic trading card is in the form of a generally rectangular metal substrate having front and rear sides, a main portion, four edge marginal portions terminating in respective substrate edges and four corner marginal portions. The edge marginal portions and the corner marginal portions surround the main portion and share respective boundaries with the main portion. Substrate indicia, such as a photograph of a player, is printed on the front side. Preferably, the substrate main portion has embossed areas which serve as design elements. In one embodiment, the metallic trading card is included in a set of cards having different indicia, and the embossed areas are design elements common to all the cards of the set.

Adjacent the substrate rear side is an insert sheet, for example made of a paper-based material such as cardboard, and having insert sheet indicia printed on an insert sheet indicia side which faces away from the substrate rear side. While the metal substrate is quite durable, and facilitates unique decorative effects, printing of a much higher quality is possible on paper-based materials compared to sheet metal, and various and attractive glossy effects can be achieved. Thus the invention combines the advantages of both mediums.

To complete the construction, the edge marginal portions and the corner marginal portions of the metal substrate are rolled towards the substrate rear side and around such that the substrate edges contact the indicia side of the insert sheet so as to retain the insert sheet in position. The rolled edge marginal portions and the rolled corner marginal portions together define a continuous bead around the periphery of the card without any exposed sharp edges.

The metallic trading card of the invention preferably is formed from a flat blank wherein the corner marginal portions have concave cutouts to avoid interference when the side marginal portions are rolled. However, each of the corner marginal portions has material remaining between its respective concave cutout and the boundary shared by the corner marginal portion and the main portion, which remaining material facilitates the forming of the continuous and smooth bead even around the corners of the finished metallic trading card.

The invention also provides a boxed set including a plurality of metallic trading cards or the like, as summarized above, each of the metallic trading cards orientable so as to have a lower edge and two side edges. The set also includes a storage tin for the trading cards. The storage tin is in the form of a generally rectangular metal receptacle having a bottom and four upright sides, and there is a metal cover for the receptacle. In the bottom of the receptacle is a lower card support member having a plurality of channels for receiving the lower edges of the trading cards. Along two opposite sides of the receptacle are a pair of side card support members, each having corresponding pluralities of channels for receiving the side edges of the trading cards.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 5 depicts a flat blank representing an initial step in the fabrication process;

FIG. 6 depicts a subsequent step in the fabrication process where edge and corner marginal portions have been bent towards the substrate rear side;

FIG. 7 is an end view on line 7—7 of FIG. 6;

DETAILED DESCRIPTION

Figure 1:
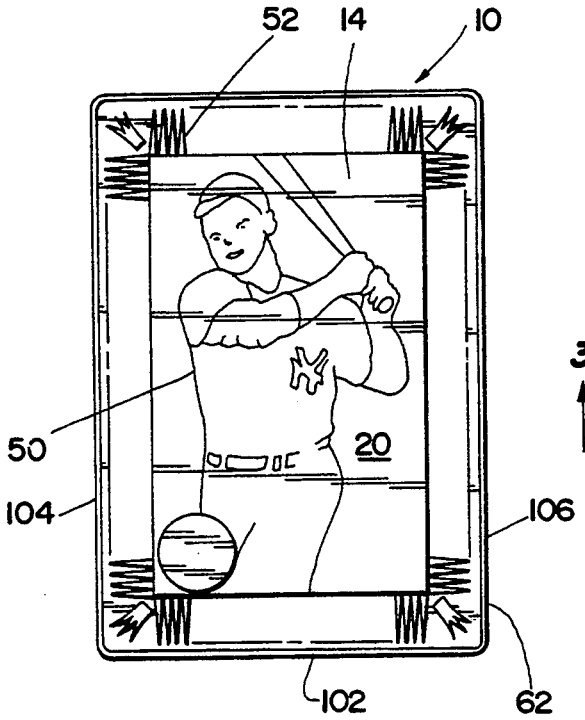
FIG. 1 is a front view of a metallic trading card in accordance with the invention.
Figure 2:
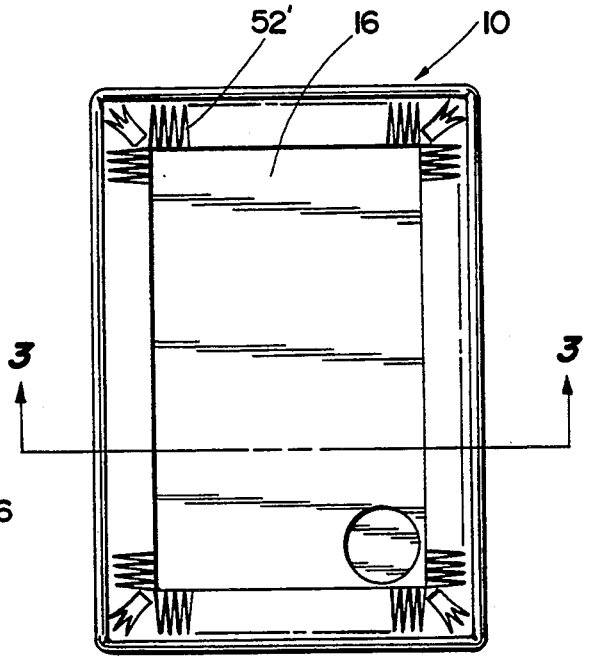
FIG. 2 is a rear view of the metallic card of FIG. 1 but omitting, for purposes of illustration, the cardboard insert sheet.
Figure 3:
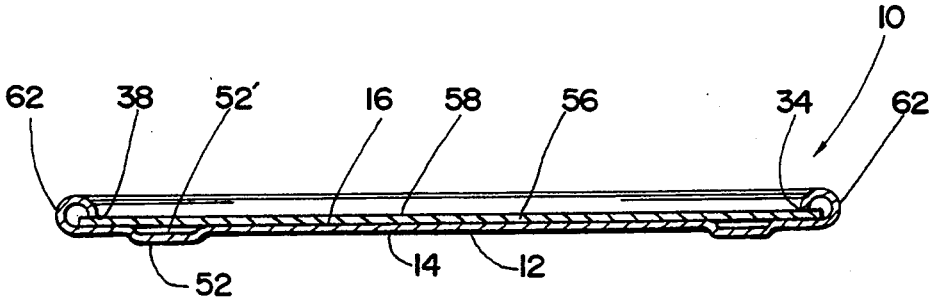
FIG. 3 is a section taken along line 3—3 of FIG. 2, but with the cardboard insert sheet in place.

Referring now to the drawings, FIGS. 1–4 depict a metallic trading card 10 in accordance with the invention except that, for convenience of illustration, the printed cardboard back insert is omitted from FIG. 2. FIGS. 5–8 depict various intermediate steps in the process of fabricating the card 10 of FIGS. 1–4. Various elements of the card 10 are referred to hereinbelow both with reference to FIGS. 1–4 and with reference to FIGS. 5–8.

The metallic trading card 10 includes a generally rectangular metal substrate 12 having a front side 14 (FIG. 1) and a rear side 16 (FIG. 2). The substrate 12 is formed from a generally rectangular flat sheet metal blank 18, represented in FIG. 5.

The substrate 12 includes a central main portion 20, which comprises most, but not all, of the portion visible in FIG. 1. In FIG. 5, the central main portion 20 is within a phantom boundary line 22. It will be appreciated that the boundary 22 depicted in phantom in FIG. 5 is not actually physically present in the blank 18; rather, the boundary 22 coincides generally with subsequent bends as the card 10 is formed from the blank 18.

As is also best seen in FIG. 5, surrounding the central main portion 20 are four edge marginal portions 24, 26, 28 and 30 terminating in respective substrate edges 32, 34, 36 and 38, and four corner marginal portions 40, 42, 44 and 46, also surrounding the main portion 20. Each of the edge marginal portions 24, 26, 28 and 30 and each of the corner marginal portions 40, 42, 44 and 46 shares a respective boundary with the main portion 20, the respective boundaries comprising segments of the boundary 22 depicted in phantom.

Substrate indicia 50 are provided on the front side 14 of the substrate 12, in the representative form of a baseball player 50. It will be appreciated, however, that the substrate indicia 50 is not so limited, and may comprise a player of any sport, any person who is to be featured on a collectible trading card, any image in general, or even mere information presented as writing.

For decorative purposes, the main portion 20 includes design elements in the form of raised or embossed areas 52. FIG. 2 depicts the same embossed areas from the rear side, which are in the form of corresponding depressions 52'. Advantageously, the card 10 may be included in a set of cards having different indicia 50, but wherein the embossed areas 52 comprise design elements common to all the cards of the set. Printed design elements may or may not coincide with the embossed areas 52, depending upon the particular design of the card 10.

Adjacent the substrate rear side 16 is an insert sheet 56 having an indicia side 58 facing away from the substrate 12 rear side 16, with insert sheet indicia such as textual material 60 on the insert sheet 56 indicia side 58. The insert sheet 56 is preferably made of a paper-based material such as thin cardboard, and has a durable finish. Thus, and as noted hereinabove, the construction of the invention combines two mediums and the advantages of each. The metal substrate provides durability and facilitates unique decorative effects, and the insert sheet 56 of paper-based material affords improved quality of printing, particularly of the textual material 60.

To retain the insert sheet 56 in position, and also to form a smooth continuous bead 62 around the entire periphery of the card 10 without any exposed sharp edges, the edge marginal portions 24, 26, 28, 30 and the corner marginal portions 40, 42, 44 and 46 are rolled towards the substrate 12 rear side 16 and then around, such that the substrate edges 32, 34, 36 and 38 contact the indicia side 58 of the insert sheet 56. To avoid interference when the side marginal portions 24, 26, 28 and 30 are rolled, the blank 18 (FIG. 5) has concave cutouts 66, 68, 70 and 72 at the corners thereof.

It is significant that each of the corner marginal portions 40, 42, 44 and 46 has material remaining between the respective concave cutout 66, 68, 70 or 72 and that portion of the boundary 22 shared by the particular corner marginal portion 40, 42, 44 or 46 and the main portion 20. This is particularly evident in the partially formed view of FIGS. 6 and 7, where material remains on the side of the partially-formed piece as indicated at 74 and 76. In the finished card 10, the result is manifested as may be seen in the enlarged corner view of FIG. 4, as well as in the cross section of FIG. 4A wherein a corresponding portion 62' of the rolled edge or bead 62 runs entirely around the depicted upper corner of the card. A terminating point 78 of the cutout 66 of FIGS. 5 and 6 becomes in the finished card 10 of FIGS. 4 and 4A, the point 78. The side edge 80 of the cutout 66 of FIG. 5 becomes in the finished card 10 the side edge 80 visible in FIG. 4 and in full in FIG. 4A.

Although aspects of the manufacturing process have been mentioned hereinabove, the manufacturing process for the card 10 will now be described in greater detail with reference to FIGS. 5–8.

Typically, the manufacturing process begins with a large "tin" sheet (e.g. thirty six inches by twenty nine and one-half inches) being printed in a four color process, employing an automatic printing press which feeds into a drying oven. Typically, images for approximately sixty to eighty trading cards 10 are printed on each of the large sheets. A suitable material is known as steel sheet, and is approximately 0.009 inch in thickness. The finished cards 10 are approximately 2½ by 3½ inches in size, with a bead 62 thickness of, for example, 3/32 inch.

The approximately sixty to eighty images or substrates are then individually cut from the large printed sheets, and are transferred to presses which cut the substrates to exact size, as represented in FIG. 5. Typically, a first punch or press having appropriate tooling is employed to cut away any excess tin sheet to form a rectangle, and then a second punch or press having appropriate tooling is employed to remove material to define the concave cutouts 66, 68, 70 and 72.

Subsequently, a third punch or press is employed to bend the edge marginal portions 24, 26, 28 and 30 and the corner marginal portions 66, 68, 70 and 72 towards the substrate rear side 16, resulting in the configuration of FIG. 6. The forming operation of this third press deforms the metal in a manner related to that of a drawing operation, wherein a degree of metal stretching occurs in a transformation from a flat configuration to a three-dimensional configuration. Again, appropriate tooling is employed.

In addition, either prior to or immediately after the forming operation of the third press, a press with suitable embossing dies is employed to form the embossed areas 52 in the main portion 20. As noted hereinabove, the embossed areas 52 may or may not correspond to printed design elements, depending upon the design of the particular card 10 or set of cards 10.

Figure 8:
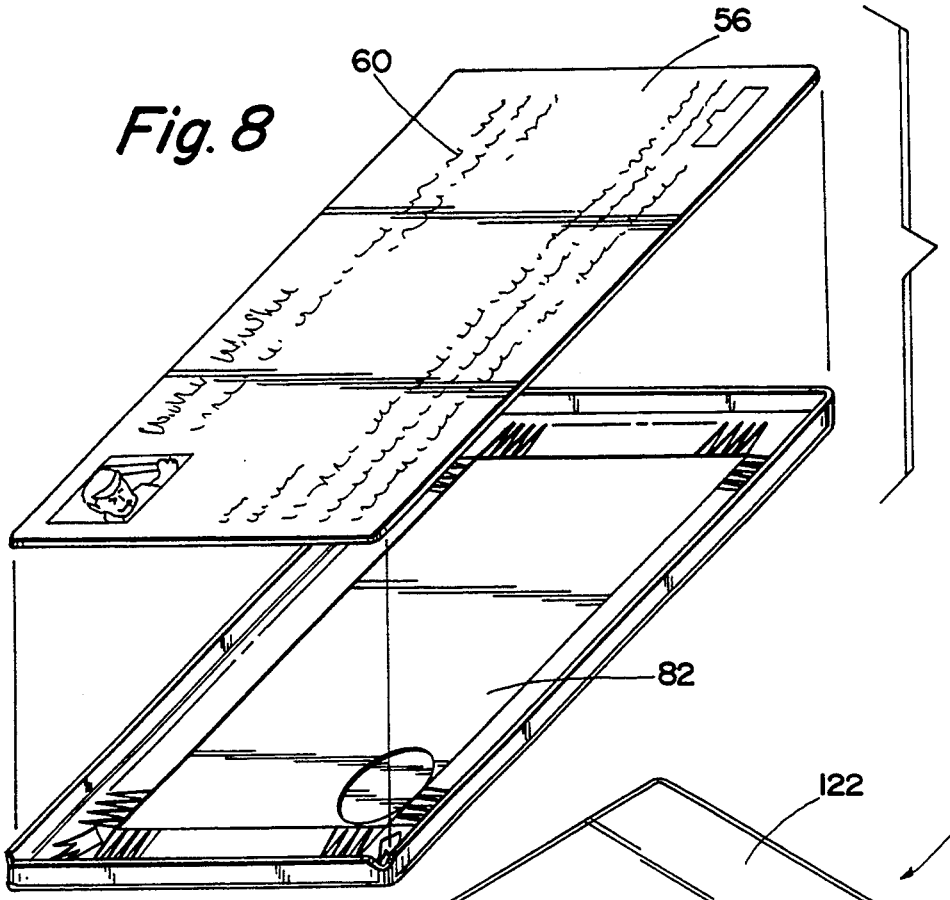
FIG. 8 depicts another subsequent step in the fabrication process wherein the rear side insert sheet is being positioned, prior to completing the rolling of the marginal portions.

Next, as is represented in FIG. 8, the partially formed card of FIG. 6 is turned over, and the insert sheet 56 is placed in the recess 82 resulting from the bending of the side marginal portions 24, 26, 28 and 30 and the edge marginal portions 40, 42, 44 and 46 towards the rear side 16. The insert sheet 56 is previously prepared, employing high quality materials, preferably paper-based, and a high quality printing process.

Figure 4A:
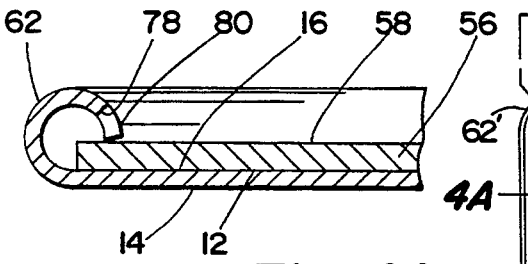
FIG. 4A is a further enlarged section taken on line 4A—4A of FIG. 4 showing corner details.
Figure 4:
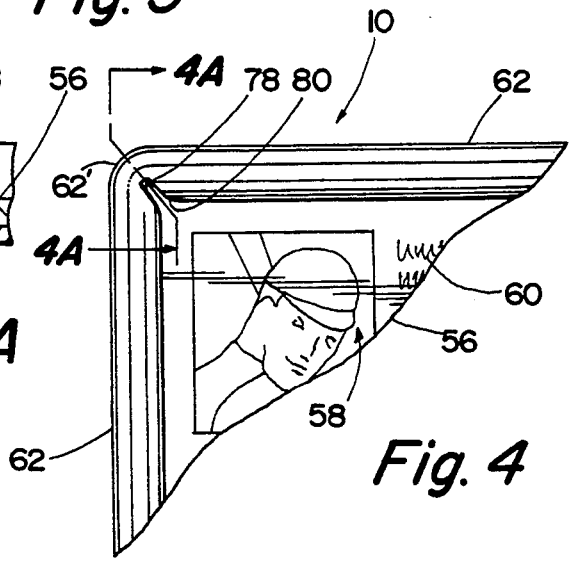
FIG. 4 is an enlarged detail generally of the upper left corner of FIG. 2, but with the cardboard insert sheet in place, and indicia on the insert sheet.

Finally, the marginal portions are rolled so as to form the bead 62 and retain the cardboard insert sheet 56 in position. During this final metal forming operation, particular care is taken, employing suitable tooling, so as to provide round corners without exposed sharp edges, the result of which is illustrated in FIGS. 4 and 4A described hereinabove.

Figure 9:
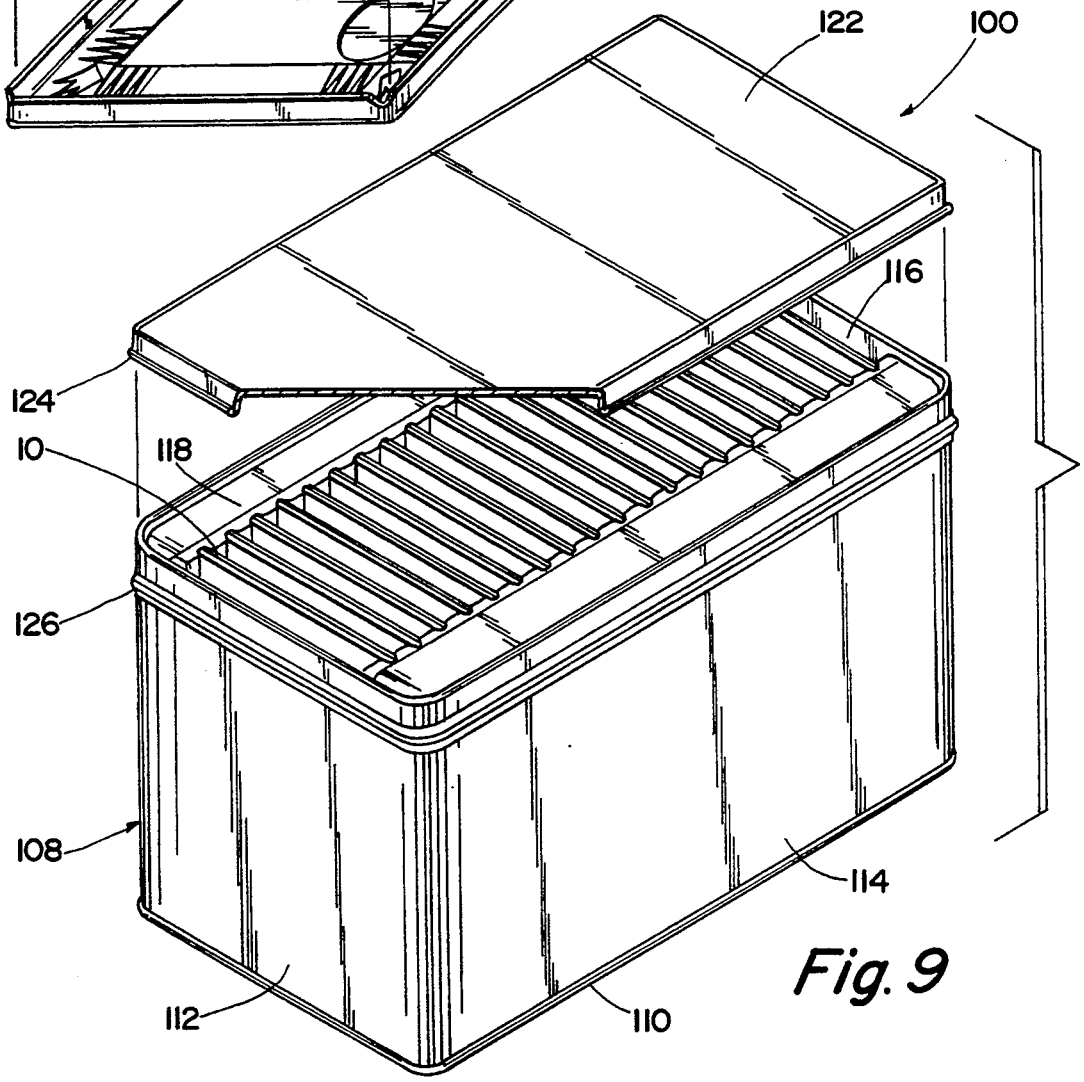
FIG. 9 depicts a boxed set of metallic trading cards.
Figure 10:
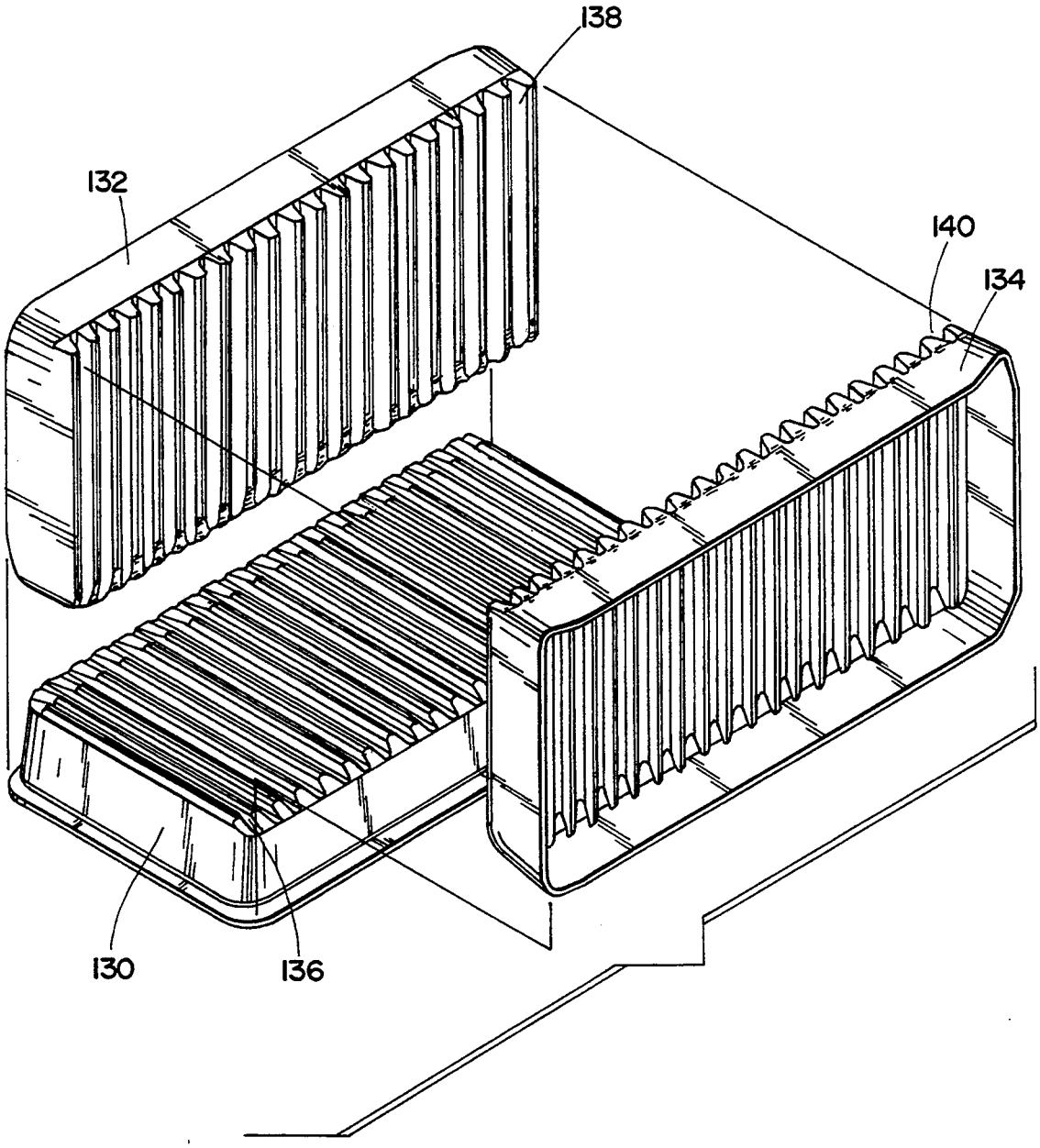
FIG. 10 is an exploded view of card support members included within the storage tin of FIG. 9.

Referring finally to FIGS. 9 and 10, FIG. 9 depicts a boxed set 100 comprising a plurality of metallic trading cards 10, each orientable (with reference to FIG. 1) so as to have a lower edge 102 and two side edges 104 and 106. The cards 10 are contained within a storage tin 108, which is in the form of a generally rectangular receptacle having a bottom 110 and four upright sides 112, 114, 116 and 118. A press fit cover or lid 122 is provided, having a rolled edge 124, and a bead 126 is formed on the sides 112, 114, 116 and 118 of the receptacle, corresponding to the closed position of the lid 122. Although not illustrated in FIG. 9, preferably the storage tin 108 and cover 122 are provided with decorative designs, printing and embossing.

Within the tin 108, and best seen in the exploded perspective view of FIG. 10, are a lower card support member 130, and a pair of side card support members 132 and 134. The card support members 130, 132 and 134 have corresponding channels 136, 138 and 140 for respectively receiving the lower edges 102 and the side edges 104 and 106 of the cards 10. Illustratively, the card support members 130, 132 and 134 comprise vacuum-formed or molded plastic elements. However, it will be appreciated that the card support elements 130, 132 and 134 may take a variety of forms.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A metallic trading card comprising:

a generally rectangular metal substrate having a front side, a rear side, a main portion, four edge marginal portions terminating in respective substrate edges, four corner marginal portions, said edge marginal portions and said corner marginal portions surrounding said main portion and sharing respective boundaries with said main portion, and substrate indicia on said front side;

an insert sheet adjacent said rear side, said insert sheet having an indicia side facing away from said rear side with insert sheet indicia thereon;

said edge marginal portions and said corner marginal portions being rolled towards said rear side such that said substrate edges contact said indicia side of said insert sheet so as to retain said insert sheet in position; and said rolled edge marginal portions and said rolled corner marginal portions together defining a continuous bead around the periphery of said card without any exposed sharp edges.

2. A metallic trading card in accordance with claim 1, which is formed from a flat blank wherein said corner marginal portions have concave cutouts to avoid interference when said side marginal portions are rolled.

3. A metallic trading card in accordance with claim 2, wherein each of said corner marginal portions has material remaining between the respective concave cutout and the boundary shared by the corner marginal portion and said main portion.

4. A metallic trading card in accordance with claim 1, wherein said substrate main portion has embossed areas.

5. A metallic trading card in accordance with claim 4 which is included in a set of cards having different indicia, and wherein said embossed areas comprise design elements common to all the cards of the set.

6. A metallic trading card in accordance with claim 1, wherein said insert sheet comprises a paper-based material.

7. A boxed set comprising:

a plurality of metallic trading cards, each orientable so as to have a lower edge and two side edges, and each of said metallic trading cards comprising a generally rectangular metal substrate having a front side, a rear side, a main portion, four edge marginal portions terminating in respective substrate edges, four corner marginal portions, said edge marginal portions and said corner marginal portions surrounding said main portion and sharing respective boundaries with said main portion, and substrate indicia on said front side, an insert sheet adjacent said rear side, said insert sheet having an indicia side facing away from said rear side with insert sheet indicia thereon, said edge marginal portions and said corner marginal portions being rolled towards said rear side such that said substrate edges contact said indicia side of said insert sheet so as to retain said insert sheet in positions, and said rolled edge marginal portions and said rolled corner marginal portions together defining a continuous bead around the periphery of said card without any exposed sharp edges; and a storage tin for said trading cards, said storage tin including a generally rectangular receptacle having a bottom and four upright sides; a cover for said receptacle; a lower card support member in said receptacle on the bottom thereof, said lower card support member having a plurality of channels for receiving the lower edges of said trading cards; and a pair of side card support members in said receptacle along two opposite sides thereof, said side card support members having corresponding pluralities of channels for receiving the side edges of said trading cards.

8. A boxed set in accordance with claim 7, wherein each of said metallic trading cards is formed from a flat blank wherein said corner marginal portions have concave cutouts to avoid interference when said side marginal portions are rolled.

9. A boxed set in accordance with claim 8, wherein each of said corner marginal portions has material remaining between the respective concave cutout and the boundary shared by the corner marginal portion and said main portion.

10. A boxed set in accordance with claim 7, wherein said metallic trading cards have different indicia, and wherein said substrate main portions have embossed areas which comprise design elements common to all the cards of the set.

11. A boxed set in accordance with claim 7, wherein said insert sheets comprise a paper-based material.

* * * * *